US008183788B2

(12) United States Patent
Ma

(10) Patent No.: US 8,183,788 B2
(45) Date of Patent: May 22, 2012

(54) LED LUMINANCE CONTROL CIRCUIT AND BACKLIGHT SOURCE OF LIQUID CRYSTAL DISPLAY

(75) Inventor: Li Ma, Beijing (CN)

(73) Assignee: Beijing Boe Optoelectronics Technology Co., Ltd. (CN)

( * ) Notice: Subject to any disclaimer, the term of this patent is extended or adjusted under 35 U.S.C. 154(b) by 1193 days.

(21) Appl. No.: 11/956,978

(22) Filed: Dec. 14, 2007

(65) Prior Publication Data

US 2008/0180461 A1 Jul. 31, 2008

(30) Foreign Application Priority Data

Jan. 30, 2007 (CN) ..... 2007 1 0063162

(51) Int. Cl.
*H05B 37/02* (2006.01)

(52) U.S. Cl. ..... 315/291; 315/307

(58) Field of Classification Search ..... 345/76, 345/77, 78, 204; 315/307, 308, 310, 291, 315/244, 246, 209 R, 185 S, 185 R, 7
See application file for complete search history.

(56) References Cited

U.S. PATENT DOCUMENTS 5,459,328 A * 10/1995 Kadota et al. ..... 250/551
7,408,308 B2 * 8/2008 Sawada et al. ..... 315/291
7,425,943 B2 * 9/2008 Furukawa ..... 345/102
7,436,125 B2 * 10/2008 Mashiko ..... 315/224
7,663,598 B2 * 2/2010 Kim ..... 345/102
7,723,926 B2 * 5/2010 Mednik et al. ..... 315/291
2006/0244396 A1 11/2006 Bucur

OTHER PUBLICATIONS

Examination Report in Chinese Patent Application No. 200710063162, 4 pages.

* cited by examiner

*Primary Examiner* — Douglas W Owens
*Assistant Examiner* — Minh D A
(74) *Attorney, Agent, or Firm* — Sheridan Ross P.C.

(57) ABSTRACT

The present invention discloses a LED luminance control circuit comprising one or several LEDs and a driving circuit, the driving circuit being connected in series with said one or several LEDs to provide energy to the one or several LEDs, wherein a control circuit is connected in parallel on both terminals of said one or several LEDs and controls on/off of the LEDs connected in parallel thereto. Connections between the several LEDs may be in parallel, in series, or combination thereof. The present invention also discloses an LED backlight source of a liquid crystal display using the above LED luminance control circuit. The present invention can implement the luminance control of various power LEDs quickly on basis of simplicity and low cost without influence on the luminance of other LEDs, by individual luminance control for every one or several LEDs, so as to solve some display technical problems when using LEDs as a display device.

8 Claims, 3 Drawing Sheets

LED LUMINANCE CONTROL CIRCUIT AND BACKLIGHT SOURCE OF LIQUID CRYSTAL DISPLAY

FIELD OF THE INVENTION

The present invention relates to an LED luminance control technology and application thereof, and particularly to the luminance control technology for one or several LEDs driven by a constant current and the application of the technology in light source for illumination, display, and on-vehicle.

BACKGROUND OF THE INVENTION

In the field of rapidly developing display technology, the LED as display device plays a more important role, and the driving and control technologies of the LED also become more important. The driving modes for the LED are roughly divided into two types, of which one is to drive by a constant voltage, and the other is to drive by a constant current. The luminance of the LED increases as the current passing therethrough increases, and the internal resistance of the LED have a slight variation during illuminating and heating. Thus, driving the LED by the constant current is better and more stable than by the constant voltage.

Under a condition of driving by the constant current, the currently common control modes for the luminance of the LED are of two types. One is to connect multiple LEDs in series, and the control for LED luminance is to load a certain control technology in the driving circuit. In such case, it is only to control the whole series of the LEDs, and there is no way for changes in the luminance of one or several LEDs among the whole series of LEDs without affecting the luminance of other LEDs. The other control mode is that a driving circuit to drive only one or several LEDs and to load the luminance control technology in the driving circuit. This luminance control solution is costly and low effective, and it may be applied for displaying in a case of small number of LEDs and without considering cost. However, in a large scale of illumination, such as backlight lamps for a liquid crystal display, this approach is not applicable due to too many LEDs.

SUMMARY OF THE INVENTION

The present invention addresses drawbacks in the prior art and provides a LED luminance control circuit to implement the luminance control of various power LEDs quickly on the basis of simplicity and low cost without influence on the luminance of other LEDs, by individual luminance control for every one or several LEDs.

To achieve above objectives, the present invention provides an LED luminance control circuit comprising one or several LEDs and a driving circuit, the driving circuit being connected in series with said one or several LEDs to provide energy to the one or several LEDs, wherein a control circuit is connected in parallel on both terminals of said one or several LEDs and controls on/off of the LED connected in parallel thereto.

In the above solution, the connection between the several LEDs is in parallel, in series, or combination of the parallel and series. Said control circuit comprises an input terminal, an operation amplifier, a N-type MosFET switch element, four resistors R1, R2, R3, R4, and a capacitor C, wherein output terminal of the operation amplifier is connected to the gate of the switch element; the drain and source of the control circuit are connected to the positive terminal and negative terminal of the one or several LEDs to be controlled, respectively; wherein resistances of said resistors R1 and R4 are the same; said input terminal is input a duty-radio-adjustable voltage signal.

The present invention also provides an LED backlight source of a liquid crystal display, which uses the foregoing LED luminance control circuits.

As compared to the prior art, the control circuit of the invention is not loaded in the driving circuit, but is connected in parallel to each LED that needs to be controlled. The invention can implement the luminance control of various power LEDs quickly on the basis of simplicity and low cost, and can particularly control the luminance of each LED in a wide range of luminance.

The present invention achieves a technical effect of controlling the luminance of one or several LEDs, particularly controlling the luminance of each LED in an LED matrix with various powers by means of controlling the voltage across the LED, and solves problems that one or several LED can not be individually controlled when the LED is used as a display device, or problems of high cost and low effectiveness.

The present invention will be further described in detail in conjunction with figures and specific embodiments.

Reference Numbers are: 1—driving circuit; 2—control circuit; 21—operation amplifier; 22—switch element; 3—LED; 4—LED board.

DETAILED DESCRIPTION OF THE PREFERRED EMBODIMENTS

Embodiment 1

Figure 1:
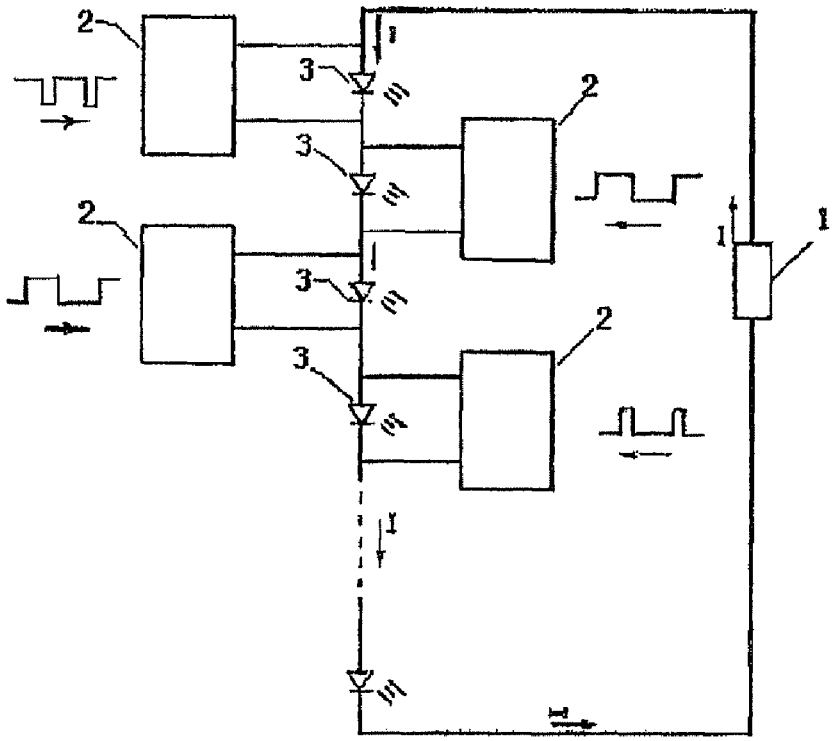
FIG. 1 is a LED luminance control circuit of the embodiment 1 of the invention.

FIG. 1 is the embodiment of a LED luminance control circuit of the invention. As shown in FIG. 1, a set of LEDs 3 connected in series are driven by a driving circuit 1, and each LED 3 is connected with a control circuit 2 in parallel.

Figure 2:
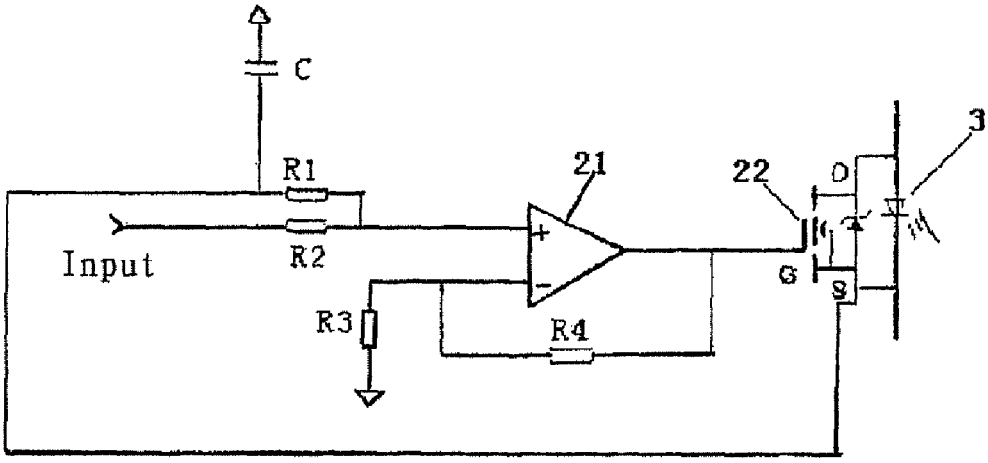
FIG. 2 is a specific circuit of the control circuit of the embodiment 1 of the invention.

FIG. 2 shows a specific circuit for the control circuit 2. As shown in FIG. 2, the control circuit comprises: an input terminal; an operation amplifier 21; a switch element 22 which is a N-type MosFET (other switch elements may also be selected); four resistors R1, R2, R3, R4; and a capacitor C. The output terminal of the operation amplifier 21 is connected to the G (gate) of the switch element 22. One terminals of the resistors R1 and R2 are connected to the positive input terminal of the operation amplifier, the other terminal of the resistor R1 is connected to the capacitor C and the S (source) of the switch element 22, the other terminal of the resistor R2 is the input terminal, and the other terminal of the capacitor C is grounded. One terminals of the resistors R3 and R4 are connected to the negative input terminal of the operation amplifier, the other terminal of the resistor R3 is grounded, and the other terminal of the resistor R4 is connected to the output terminal of the operation amplifier. The D (drain) and S (source) of the control circuit 22 are connected to the positive terminal and negative terminal of the LEDs respectively.

In the present embodiment, the resistances of R1, R2, R3, R4 are R1=10 k, R2=10 k, R3=15 k, R4=10 k respectively, and also can be R1=100 k, R2=80 k, R3=20 k, R4=100 k. The resistances may be different as requirement, but R1=R4 is required. Capacitance of the capacitor C is 0.1μ, and may be other values as requirement.

At the input terminal of the control circuit, a voltage signal of which the frequency and duty ratio are adjustable is input, and the voltage signal's amplitude may be different according to the number of LEDs to be controlled. In the present embodiment, the amplitudes of the voltage signal are +5V and −5V. When a voltage of +5V is input to the input terminal of the control circuit, this voltage is added to a voltage on the negative terminal of the LED, then the added voltage is output to the gate of the N-type MosFET. At this time, the N-type MosFET turns on, and the current that passes through the LED will pass through the N-type MosFET, such that the LED is bypassed and blacked out. Otherwise, when a voltage of −5V is input to the input terminal, the N-type MosFET turns off, and the LED illuminates normally. If no obvious flicker is desired, the input frequency may be adjusted. The higher the frequency becomes, more uniform the changes in the luminance of the LED will be, while the luminance of LED may be adjusted by adjusting the duty ratio of the input voltage signal. The longer the time occupied by the input +5V voltage signal is, the lower the LED luminance will be.

The present embodiment is featured in that the "On" and "Off" of the N-type MosFET is switched by changing a duty-ratio-adjustable voltage signal so as to adjust the luminance of LED.

Embodiment 2

Figure 3:
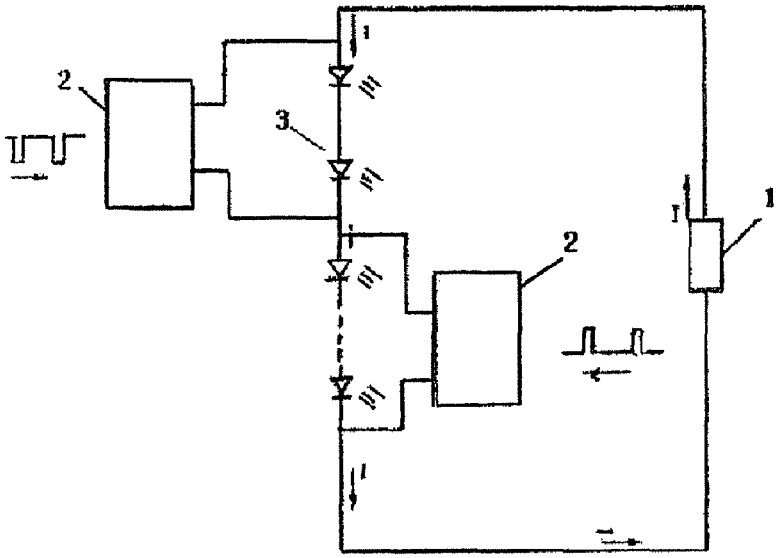
FIG. 3 is a LED luminance control circuit of the embodiment 2 of the invention.
Figure 4:
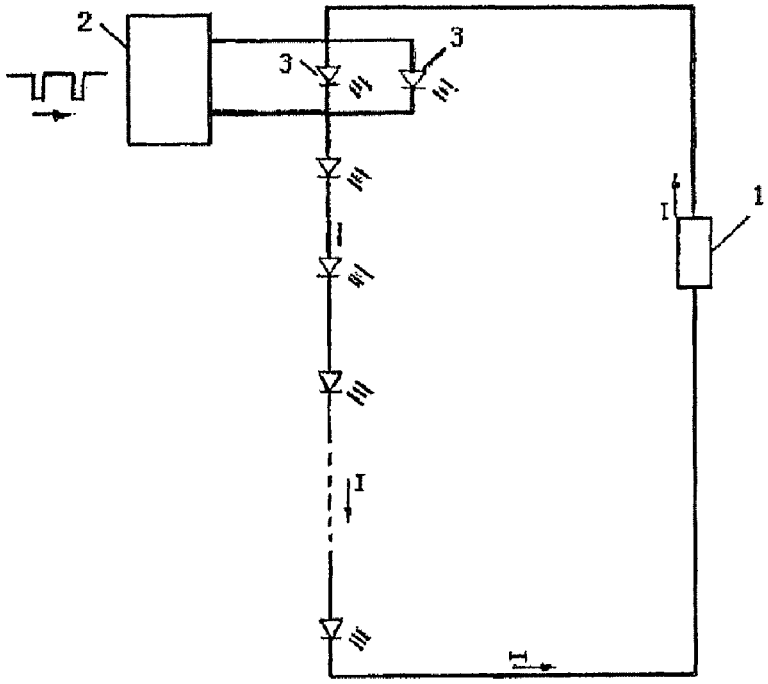
FIG. 4 is a LED luminance control circuit of the embodiment 3 of the invention.

FIG. 3 shows another embodiment of the LED luminance control circuit of the invention. As shown in FIG. 3, each control circuit 2 may control the luminance of two or more LEDs 3.

The control circuit 2 of the present embodiment is the same as that of Embodiment 1, as shown in FIG. 2. The N-type MosFET is also chosen as the switch element of the control circuit 2. When two LEDs are controlled, the amplitudes of the input voltage may be selected as +10V, −10V, the resistors may be selected as R1=10 k, R2=8 k, R3=25 k, R4=10 k, and the capacitance of the capacitor may be selected as 0.1μ.

When the luminance of more than two LEDs are controlled, the amplitudes of the input voltage may be selected based on V>n*VLED+2.5. The control principle thereof is the same as that in Embodiment 1.

Embodiment 3

FIG. 3 shows the third embodiment of the LED luminance control circuit of the invention. As shown in FIG. 3, each control circuit 2 in the present embodiment may control the luminance of two or more LEDs connected in parallel.

The control circuit 2 of the present embodiment is the same as that of Embodiment 1, as shown in FIG. 2. The N-type MosFET is also chosen as the switch element of the control circuit 2. When two LEDs are controlled, the amplitudes of the input voltage may be selected as +5V, −5V, the resistors may be selected as R1=20 k, R2=8 k, R3=30 k, R4=20 k, and the capacitance of the capacitor may be selected as 0.01μ.

When a voltage of +5V is input to the input terminal, the MosFET turns on and all the LEDs connected in parallel are blacked out. Otherwise, if a voltage of −5V is input, the MosFET turns off and all the LEDs connected in parallel illuminates. According to different frequencies and duty ratio of the input positive/negative voltage, uniformity and luminance of LEDs will be different. In this embodiment, the luminance of the LEDs connected in parallel may be controlled concurrently without affecting the luminance of the other LEDs according to the On/Off of the MosFET.

Embodiment 4

Figure 5:
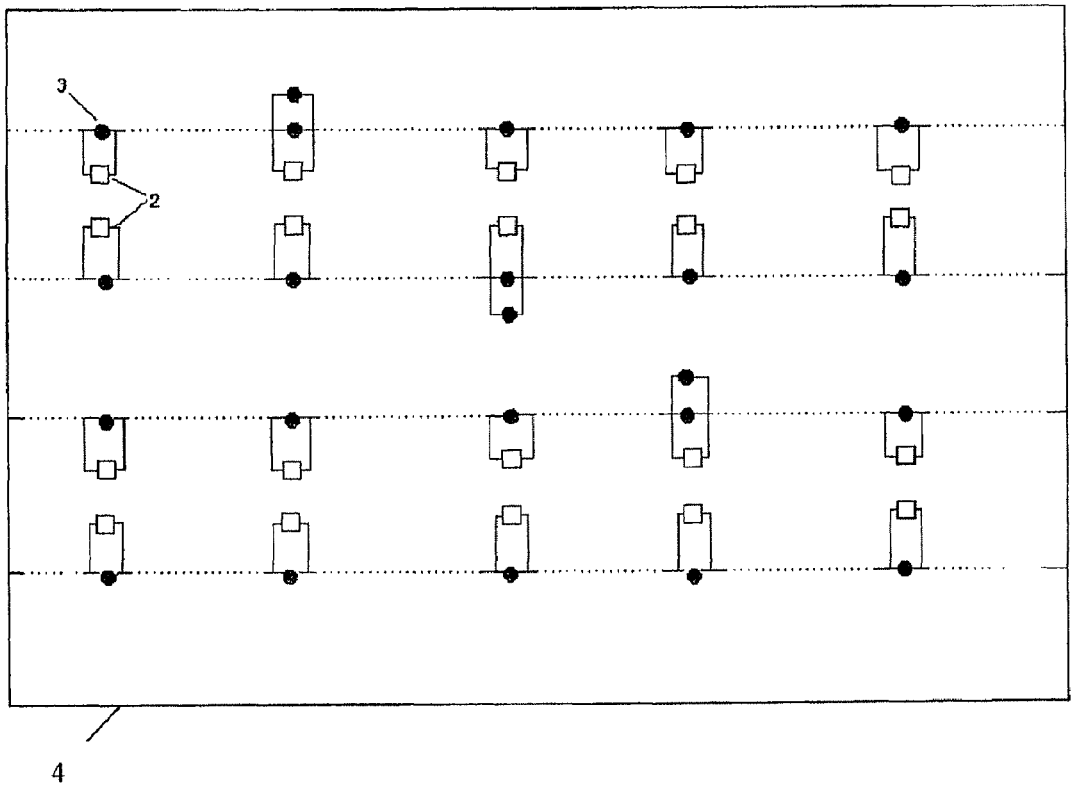
FIG. 5 is a schematic diagram of the LED luminance control circuit of the embodiment 3 of the invention applying to a liquid crystal display backlight source.

FIG. 5 shows the fourth embodiment of the invention, which is an LED board comprising multiple LEDs connected in series/parallel. The LEDs are indicated by reference numeral 3 in the figure, and a control circuit 2 is connected in parallel with the LED 3 that needs to be controlled.

This embodiment may be applied to use the LED as a backlight source of a liquid crystal television. When various power LEDs are used as the backlight source, several tens or even thousands of the LEDs are required, so the luminance control of the LED will be significantly important. This embodiment may control the luminance of a single LED in a wide range, thus it may implement a dynamic LED backlight. The dynamic LED backlight can improve the uniformity and color saturation of the backlight source, and lower the power consumption and the heat of the LEDs.

In this embodiment, a signal processing system receives a signal of the current front liquid crystal display screen, processes the signal into a corresponding PWM voltage signal, and then transmits the processed signal to the input terminal of the present embodiment for controlling the luminance of each LED. That is, the LEDs illuminate at positions there are images and black out at positions there is no image. Thus, the heating problem of the LED will be greatly solved, and the power consumption is lowered and the contrast is increased.

The present embodiment is to control the luminance of every one or several LEDs based on the constant current driving the LED matrix by using a voltage comparison switch technology which not only solves the luminance control problem in the LED used as display device, but also lowers total power consumption of the circuit. Especially in fields of large-scale display and backlight, this control method can implement the LED luminance control quickly and simply with low cost.

Various variations in form may be made to the various specific embodiments given above. For example, the number of the LEDs controlled by a control circuit may be changed so that the controlled multiple LEDs are connected in parallel, in series, or by combination thereof, and a diversity design may be made to the number and connection pattern of the LEDs controlled by the multiple control circuits, etc.

It should be finally noted that the above embodiment is only used as a description to technical solution of the invention but not as a limitation. Although the invention is described with reference to the preferable embodiments, those skilled in the art shall understand that the invention can be realized by different materials and devices, i.e., the technical solution of the invention can be modified or equivalently alternated without departing from the spirits and scopes of the invention.

What is claimed is:

1. A LED luminance control circuit comprising one or several LEDs and a driving circuit, the driving circuit being connected in series with said one or several LEDs to provide energy to the one or several LEDs, wherein a control circuit is connected in parallel on both terminals of said one or several LEDs, and controls on/off of the LED connected in parallel thereto; and wherein said control circuit comprises:

an input terminal, an operation amplifier, a N-type MosFET switch element, four resistors R1, R2, R3, R4, and a capacitor C, wherein the output terminal of the operation amplifier is connected to the gate of the switch element; one terminal of each of the resistors R1 and R2 is connected to the positive input terminal of the operation amplifier, the other terminal of the resistor R1 is connected to one terminal of the capacitor C and the source of the switch element, the other terminal of the resistor R2 is the input terminal, and the other terminal of the capacitor C is grounded; one terminal of each of the resistors R3 and R4 is connected to the negative input terminal of the operation amplifier, the other terminal of the resistor R3 is grounded, and the other terminal of the resistor R4 is connected to the output terminal of the operation amplifier; the drain and source of the switch element are connected to the positive terminal and negative terminal of the one or several LEDs to be controlled, respectively.

2. The LED luminance control circuit of claim 1, wherein the connection between the several LEDs is in parallel, in series, or a combination of the parallel and series.

3. The LED luminance control circuit of claim 1, wherein the resistances of said resistors R1 and R4 is the same.

4. The LED luminance control circuit of claim 1, wherein said input terminal is input a duty-radio-adjustable voltage signal.

5. A LED backlight source of a liquid crystal display, including a LED luminance control circuit comprising one or several LEDs and a driving circuit, the driving circuit being connected in series with said one or several LEDs to provide energy to the one or several LEDs, characterized in that a control circuit is connected in parallel on both terminals of said one or several LEDs, and controlling on/off of said one or several LEDs connected in parallel thereto; and wherein said control circuit comprises:

an input terminal, an operation amplifier, a N-type MosFET switch element, four resistors R1, R2, R3, R4, and a capacitor C, wherein the output terminal of the operation amplifier is connected to the gate of the switch element; one terminal of each of the resistors R1 and R2 is connected to the positive input terminal of the operation amplifier, the other terminal of the resistor R1 is connected to one terminal of the capacitor C and the source of the switch element, the other terminal of the resistor R2 is the input terminal, and the other terminal of the capacitor C is grounded; one terminal of each of the resistors R3 and R4 is connected to the negative input terminal of the operation amplifier, the other terminal of the resistor R3 is grounded, and the other terminal of the resistor R4 is connected to the output terminal of the operation amplifier; the drain and source of the switch element are connected to the positive terminal and negative terminal of the one or several LEDs to be controlled, respectively.

6. The LED backlight source of a liquid crystal display of claim 5, wherein the connection between the several LEDs is in parallel, in series, or a combination of the parallel and series.

7. The LED backlight source of a liquid crystal display of claim 5, wherein the resistances of said resistors R1 and R4 is the same.

8. The LED backlight source of a liquid crystal display of claim 5, wherein said input terminal is input a duty-radio-adjustable voltage signal.

* * * * *